US006857971B2

(12) United States Patent
Huang

(10) Patent No.: US 6,857,971 B2
(45) Date of Patent: Feb. 22, 2005

(54) SINGLE PANEL GOLF CLUB GRIP

(76) Inventor: Ben Huang, 19472 Woodlands La., Huntington Beach, CA (US) 92648

( * ) Notice: Subject to any disclaimer, the term of this patent is extended or adjusted under 35 U.S.C. 154(b) by 0 days.

(21) Appl. No.: 10/392,480

(22) Filed: Mar. 18, 2003

(65) Prior Publication Data

US 2004/0185958 A1 Sep. 23, 2004

(51) Int. Cl.[7] ..... A63B 53/14
(52) U.S. Cl. ..... 473/300
(58) Field of Search ..... 473/300–303, 473/549, 568; 74/55.19; 81/489; 16/421; 280/821

(56) References Cited

U.S. PATENT DOCUMENTS

| | | | | |
|---|---|---|---|---|
| 571,025 | A | | 11/1896 | Spamer |
| 1,008,604 | A | | 11/1911 | Lake |
| 1,345,505 | A | | 7/1920 | Persons |
| 1,617,972 | A | | 2/1927 | Wallace |
| 1,890,037 | A | | 12/1932 | Johnson |
| 2,221,421 | A | | 11/1940 | Curry |
| 2,449,575 | A | | 9/1948 | Wilhelm |
| 2,523,637 | A | | 9/1950 | Stanfield et al. |
| 2,690,338 | A | | 9/1954 | Brocke |
| 2,984,486 | A | | 5/1961 | Jones |
| 3,095,198 | A | | 6/1963 | Gasche |
| 3,311,375 | A | * | 3/1967 | Onions ..... 473/301 |
| 4,052,061 | A | | 10/1977 | Stewart |
| 4,133,529 | A | | 1/1979 | Gambino |
| 4,651,991 | A | | 3/1987 | McDuff |
| 4,662,415 | A | | 5/1987 | Proutt |
| 4,765,856 | A | | 8/1988 | Doubt |
| 4,878,667 | A | | 11/1989 | Tosti |
| 4,919,420 | A | | 4/1990 | Sato |
| 4,941,232 | A | | 7/1990 | Decker et al. |
| 5,118,107 | A | | 6/1992 | Bucher |
| 5,123,646 | A | | 6/1992 | Overby et al. |
| 5,469,601 | A | | 11/1995 | Jackson |
| 5,511,445 | A | | 4/1996 | Hildebrandt |
| 5,570,884 | A | | 11/1996 | Carps |
| 5,571,050 | A | | 11/1996 | Huang |
| 5,577,722 | A | | 11/1996 | Glassberg |
| 5,584,482 | A | | 12/1996 | Huang |
| 5,611,533 | A | | 3/1997 | Williams |
| 5,624,116 | A | | 4/1997 | Yeh |
| 5,626,527 | A | | 5/1997 | Eberlein |
| 5,645,501 | A | | 7/1997 | Huang |
| 5,671,923 | A | | 9/1997 | Huang |
| 5,730,669 | A | * | 3/1998 | Huang ..... 473/549 |
| 5,772,524 | A | | 6/1998 | Huang |
| 5,797,813 | A | | 8/1998 | Huang |
| 5,816,933 | A | | 10/1998 | Huang |
| 5,890,260 | A | | 4/1999 | Gaunt |
| 5,890,972 | A | | 4/1999 | Huang |
| 6,036,607 | A | * | 3/2000 | Finegan ..... 473/206 |
| 6,449,803 | B1 | * | 9/2002 | McConchie ..... 16/431 |
| 6,503,153 | B2 | | 1/2003 | Wang |
| 6,558,270 | B2 | | 5/2003 | Kwitek |
| 2002/0142900 | A1 | * | 10/2002 | Wang ..... 482/148 |
| 2002/0173371 | A1 | | 11/2002 | Lamkin et al. |
| 2003/0040384 | A1 | | 2/2003 | Falone et al. |
| 2003/0148836 | A1 | | 8/2003 | Falone et al. |
| 2003/0150081 | A1 | | 8/2003 | Wang |
| 2003/0216192 | A1 | | 11/2003 | Chu |

* cited by examiner

*Primary Examiner*—Stephen Blau
(74) *Attorney, Agent, or Firm*—Knobbe Martens Olson & Bear LLP

(57) ABSTRACT

A grip for the handle of a golf club having a single polyurethane-felt panel that is wrapped about an underlisting sleeve. The side edges of the panel are adhesively sealed together. The unitary grip reduces impact shock and also provides a feeling of tackiness in the manner of a spirally wrapped polyurethane-felt grip.

28 Claims, 17 Drawing Sheets

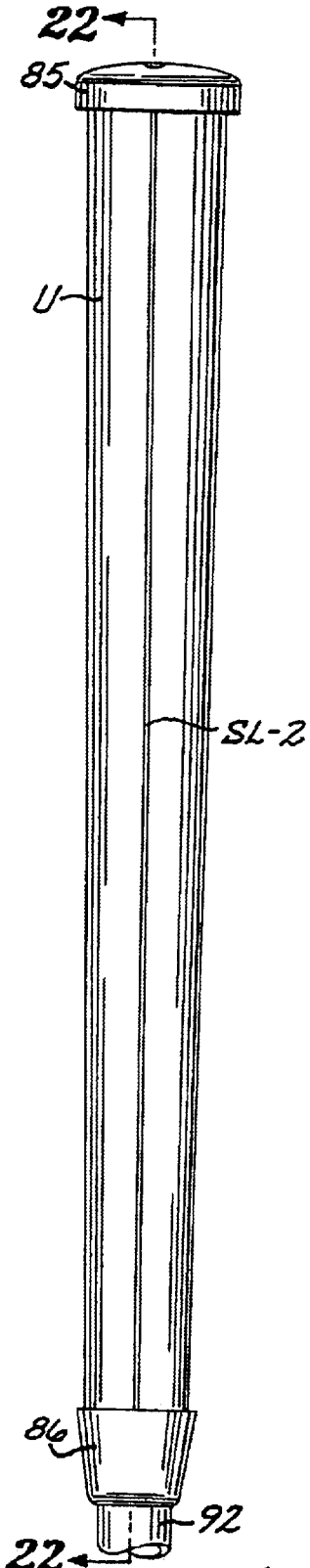
FIG. 21
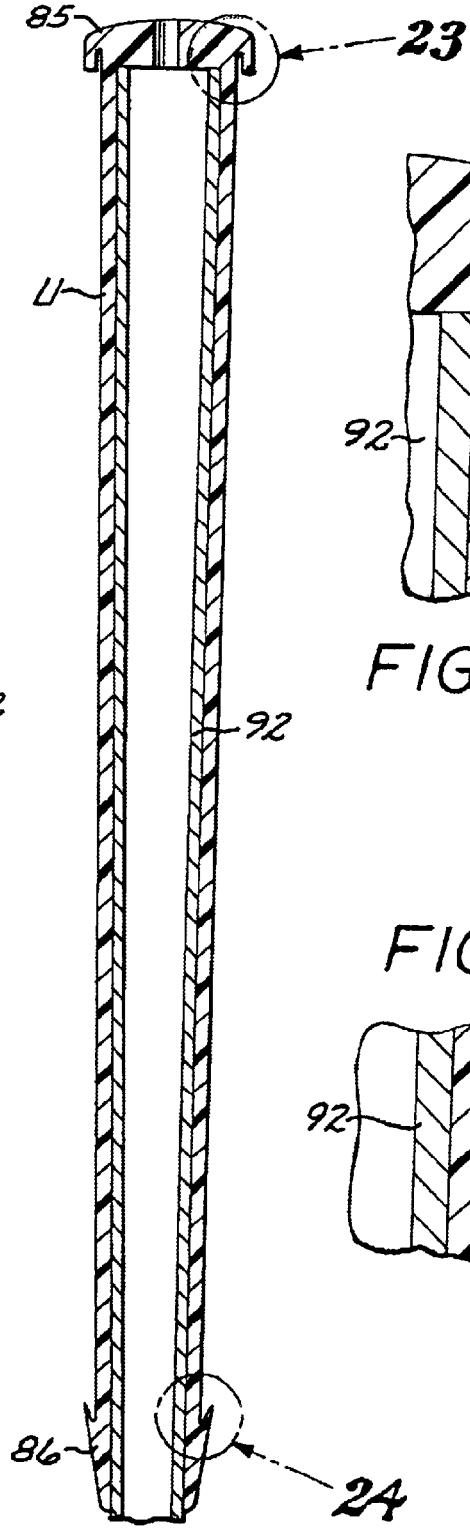
FIG. 22
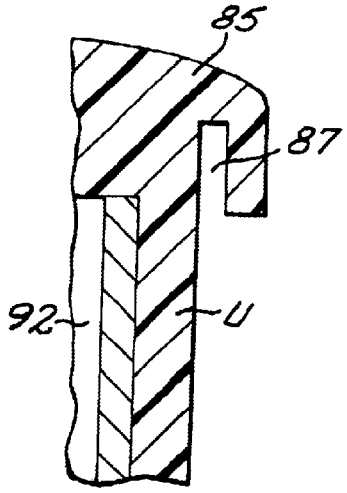
FIG. 23
FIG. 24
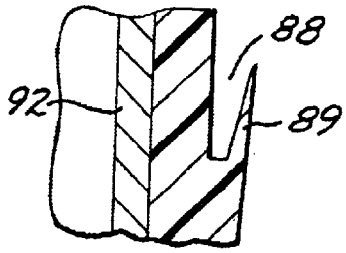

60
62
U
82
90
91
92
93
94
95
S
36
38

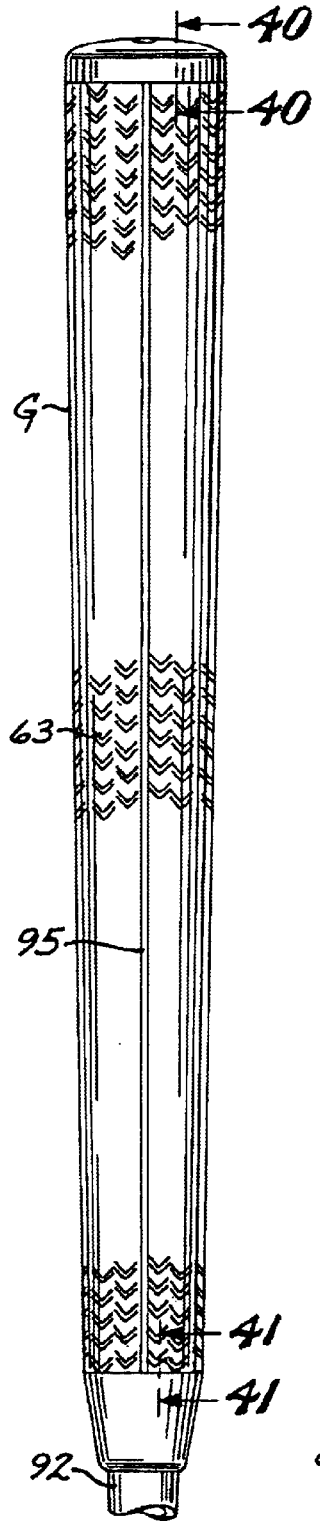
FIG.39
FIG.40
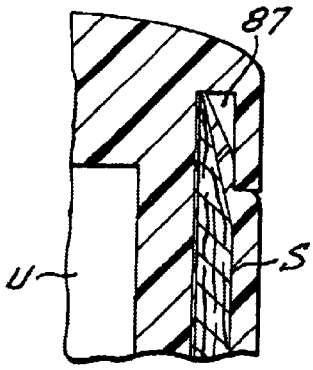
FIG.41
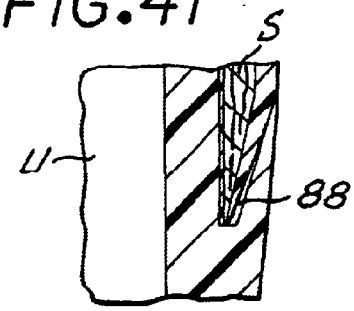
FIG.44
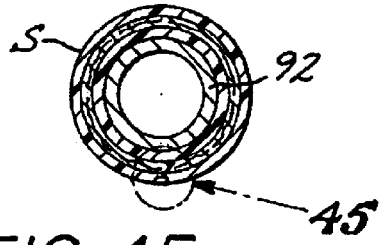
FIG.45
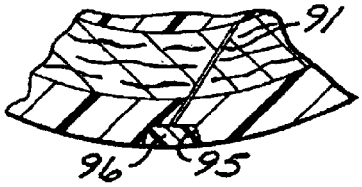
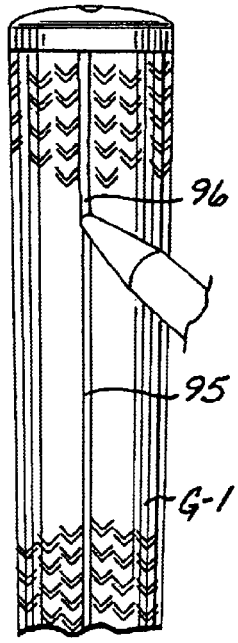
FIG.42
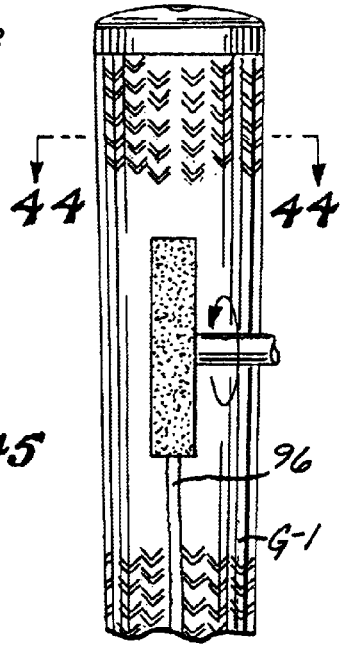
FIG.43

92
67
67
68
68
100
113
100
69
100
5
100
63a
91
60
62
U
63a
5
63
55

SINGLE PANEL GOLF CLUB GRIP

BACKGROUND OF THE INVENTION

1. Field of the Invention

The present invention relates to an improved grip for golf clubs.

2. Description of Prior Art

Applicant has previously developed resilient grips which successfully reduce impact shock to the muscle and arm joints of the user's of golf clubs and also provide a feeling of tackiness between a player's hands and the grip. See for example U.S. Pat. No. 5,797,813 granted to Applicant on Aug. 25, 1998. Such earlier grips utilize a polyurethane-felt strip which is spirally wrapped around an underlisting sleeve that is slipped onto and adhered to a golf club handle. The sides of the strips are formed with overlapping heat depressed recessed reinforcement edges. While such grips have proven satisfactory in reducing impact shock, their fabrication is labor intensive, particularly since the strip must be wrapped manually about the underlisting sleeve within specific pressure parameters. Additionally, it is difficult to accurately align the adjoining side edges of the strip as such strip is being spirally wrapped about underlisting sleeve. The strip of such wrapped grips can become twisted during the wrapping process. This is a particularly difficult problem when wrapping putter grips. These wrapped grips also do not lend themselves to the display of decorative designs.

SUMMARY OF THE INVENTION

The golf club grip of the present invention overcomes the aforementioned disadvantages of existing spirally wrapped grips while providing the same resistance to shock afforded by such grips, as well as providing tackiness. The disadvantages are eliminated by forming a structurally integral grip from a single polyurethane-felt panel having a configuration corresponding to the exterior shape of an underlisting sleeve. The side edges of such single panel abut one another and are adhered together to define a longitudinal seam extending through the panel. A heat formed recessed sealing channel may be formed in the exterior portion of the polyurethane layer at the outer end of the seam to strengthen such seam. Hot polyurethane is deposited along the seam or within the channel, and after such polyurethane has hardened it is buffed to smoothly blend into the surface of the grip. In another modification, a mold is utilized to emboss a friction enhancing pattern over the deposited polyurethane to match the friction enhancing pattern of the main body of the surface of the grip.

The golf club grip of the present invention may be manufactured at considerably less cost than existing spirally wrapped grips, since the intensive labor of spirally wrapping a strip around an underlisting sleeve within specific pressure parameters is eliminated. Additionally, the single panel grip of the present invention will not twist either during manufacture or after it is adhered to an underlisting sleeve. My new grip has an appearance similar to conventional molded rubber grips so as to appeal to professional golfers and low-handicap amateurs, and also provides a greater area for the application of decorative designs.

These and other objects and advantages of the present invention will become apparent from the following detailed description when taken in conjunction with the accompanying drawings.

BRIEF DESCRIPTION OF THE DRAWINGS

FIG. 21 is a side elevational view of an underlisting sleeve member of the single panel grip of the present invention;

FIG. 22 is a vertical sectional taken along line 22—22 of FIG. 21;

FIG. 23 is an enlarged view of the encircled area designated 23 in FIG. 22;

FIG. 24 is an enlarged view of the encircled area designated 24 in FIG. 22;

FIG. 39 is a side elevational view of a completed single panel grip embodying the present invention;

FIG. 40 is a vertical sectional view taken in enlarged scale along line 40—40 of FIG. 39;

FIG. 41 is a vertical sectional view taken in enlarged scale along line 41—41 of FIG. 39;

FIG. 42 is a broken side elevational view showing the first step in making a modification of the grip of FIG. 41;

FIG. 43 is a broken side elevational view showing a second step in making the grip of FIG. 42;

FIG. 44 is a horizontal sectional view taken along line 44—44 of FIG. 43;

FIG. 45 is an enlarged view of the encircled area designated 45 in FIG. 44;

DETAILED DESCRIPTION OF THE PREFERRED EMBODIMENTS

Figure 71:
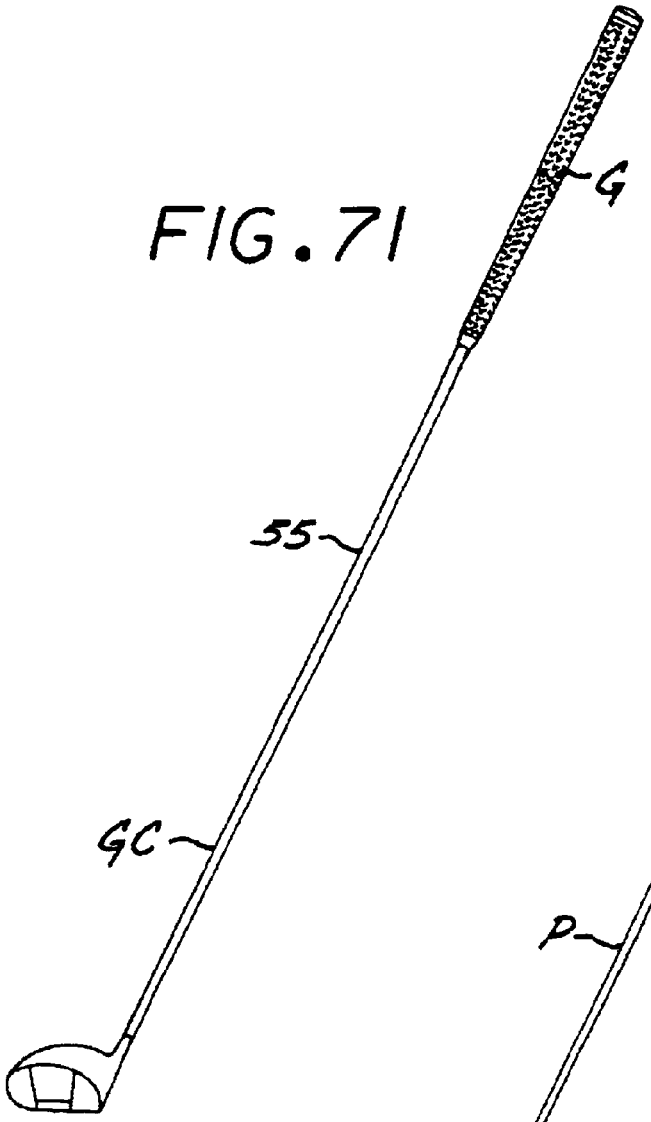
FIG. 71 is a perspective view of a golf club provided with a single panel grip embodying the present invention.
Figure 72:
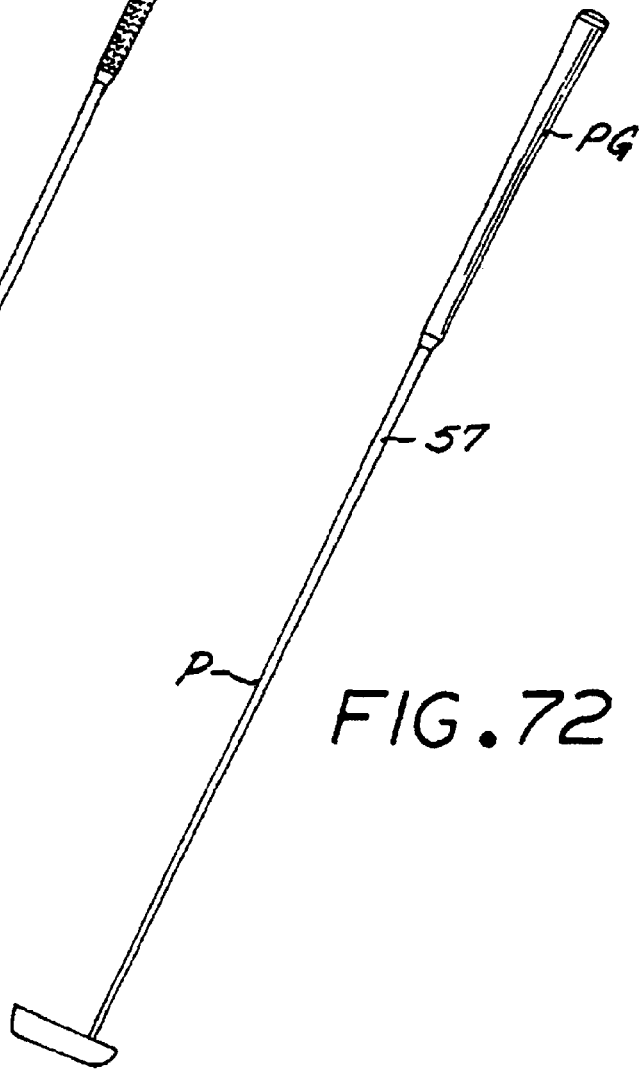
FIG. 72 is a perspective view showing a putter provided with a single panel grip embodying the present invention.

Referring to the drawings, in FIG. 71 a single panel grip G embodying the present invention is shown attached to the shaft 55 of a golf club GC. In FIG. 72 a single panel putter grip PG is shown attached to the shaft 57 of a putter P. Referring now to the remaining drawings, a preferred form of grip G includes a single panel S formed of bonded-together layers of polyurethane 60 and a felt 62 which is wrapped about and adhered to a resilient underlisting sleeve U of conventional construction.

Figure 1:
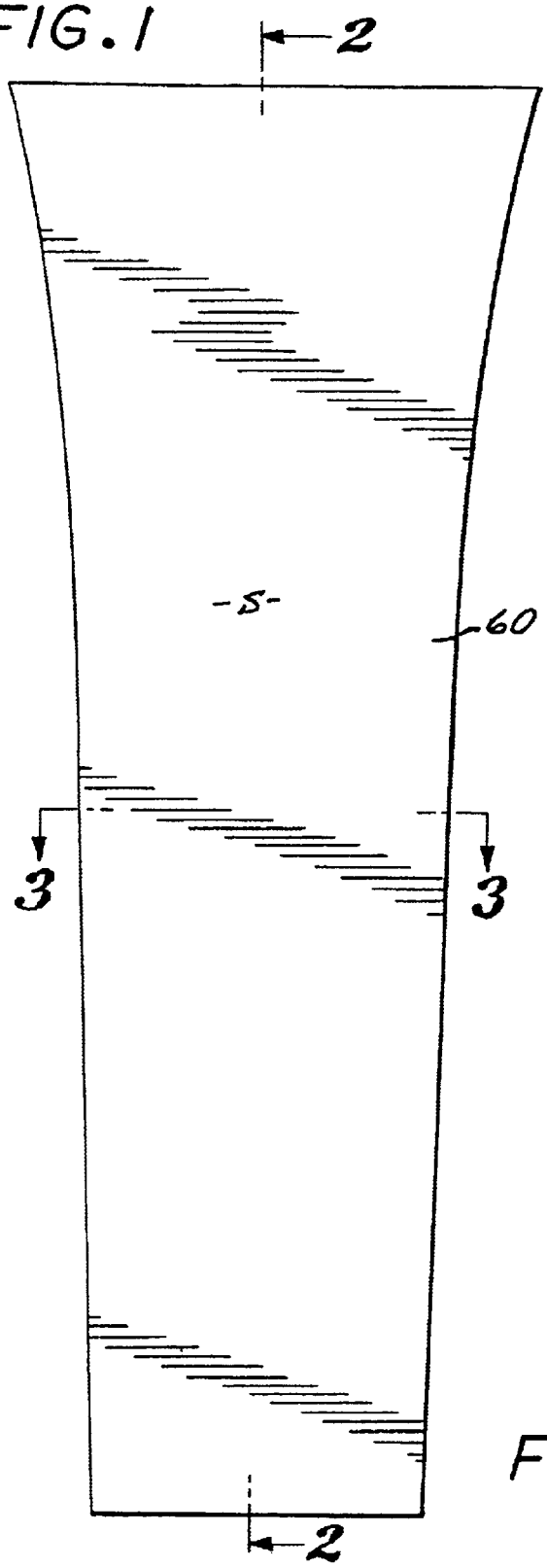
FIG. 1 is a side view of a single polyurethane-felt panel member of a golf club grip embodying the present invention.
Figure 2:
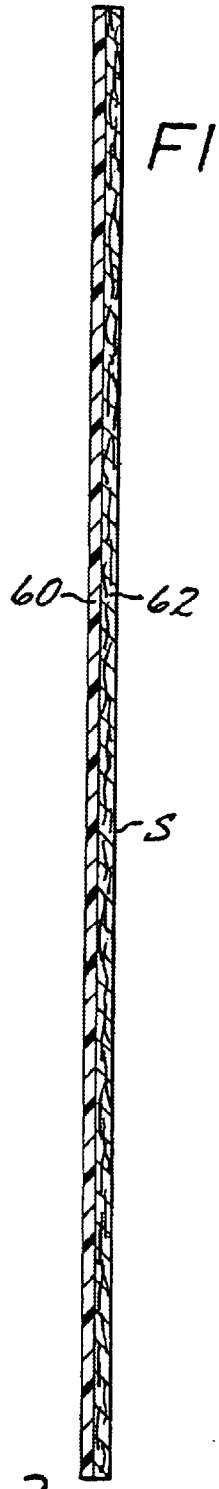
FIG. 2 is a vertical sectional view taken along line 2—2 of FIG. 1.
Figure 3:
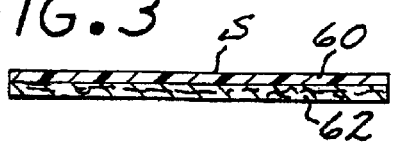
FIG. 3 is a horizontal sectional view taken along line 3—3 of FIG. 1.
Figure 4:
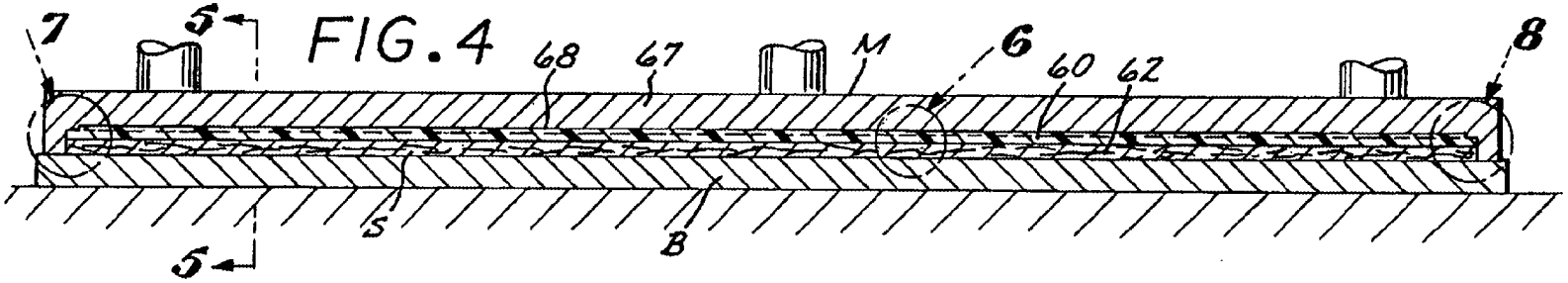
FIG. 4 is a horizontal sectional view showing a first mold which may be utilized in forming a single panel grip of the present invention.

More particularly, referring to FIGS. 1, 2 and 3, the felt layer 62 has its outer surface bonded to the inner surface of polyurethane layer 60, with such polyurethane layer preferably being coagulated to define pores (not shown). The felt layer may be fabricated of wool, polyester, nylon or mixtures thereof. Preferably, a nylon polyester felt will be utilized. The polyurethane layer 60 may be formed in a conventional manner by coating one side of a felt strip with a solution of polyurethane (e.g., polyester, polyether) dissolved in dimethyl formamide (DMF), immersing the coated strip in water baths to displace the DMF and cause the urethanes to coagulate, and finally driving off the water by the application of pressure and heat. The solids content of the polyurethane layer will vary in accordance with the desired hardness of such polyurethane layer. A preferred solids content solution is approximately 28.5–30.5%, with a viscocity range of about 60,000–90,000 cps measured at 25±0.5 degrees C. Suitable polyurethane ingredients can be purchased from the following companies:

Lidye Chemical Co., Ltd.
10F1 Lidye-Commercial Bldg.
22 Nanking W. Road, Taipei
Taiwan, R.O.C.

Lidye Chemical Co., Ltd.
No. 17, Ching Chien 6$^{th}$ Road
Guan in Industrial Area, Guan In Shiang
Taoyuan Hsien, Taiwan, R.O.C.

Lidye Resin (Panyu) Co., Ltd.
Xiadao Industrial Park
Liye Road, Dongchong Town
Panyu City, Guangdong Province, PRC.

Preferably, the thickness of the polyurethane layer will be about 0.3–0.5 millimeters and the thickness of the felt layer about 0.8–1.7 millimeters. The polyurethane layer 60 provides a cushioned grasp of a golfer's hands on a golf club and also enhances the golfer's grip by providing increased tackiness between the player's hand and the grip. The felt layer 62 provides strength to the polyurethane layer and serves as a means for attaching the bonded-together polyurethane and felt panel to underlisting sleeve U.

Figure 6:
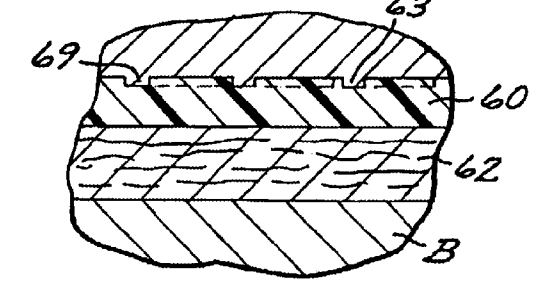
FIG. 6 is an enlarged view of the encircled area designated 6 in FIG. 4.
Figure 8:
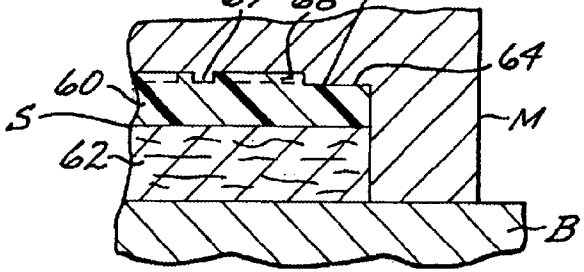
FIG. 8 is an enlarged view of the encircled area designated 8 in FIG. 4.
Figure 5:
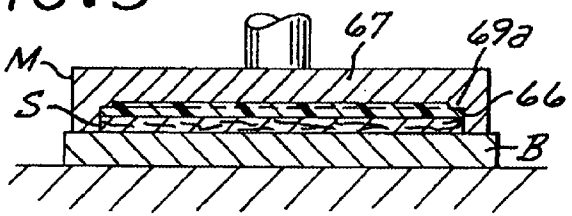
FIG. 5 is a vertical sectional view taken along line 5—5 of FIG. 4.
Figure 7:
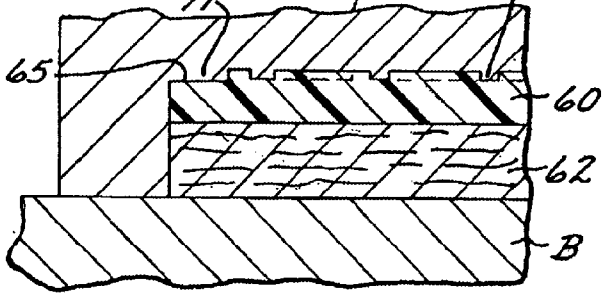
FIG. 7 is an enlarged view of the encircled area designated 7 in FIG. 4.
Figure 9:
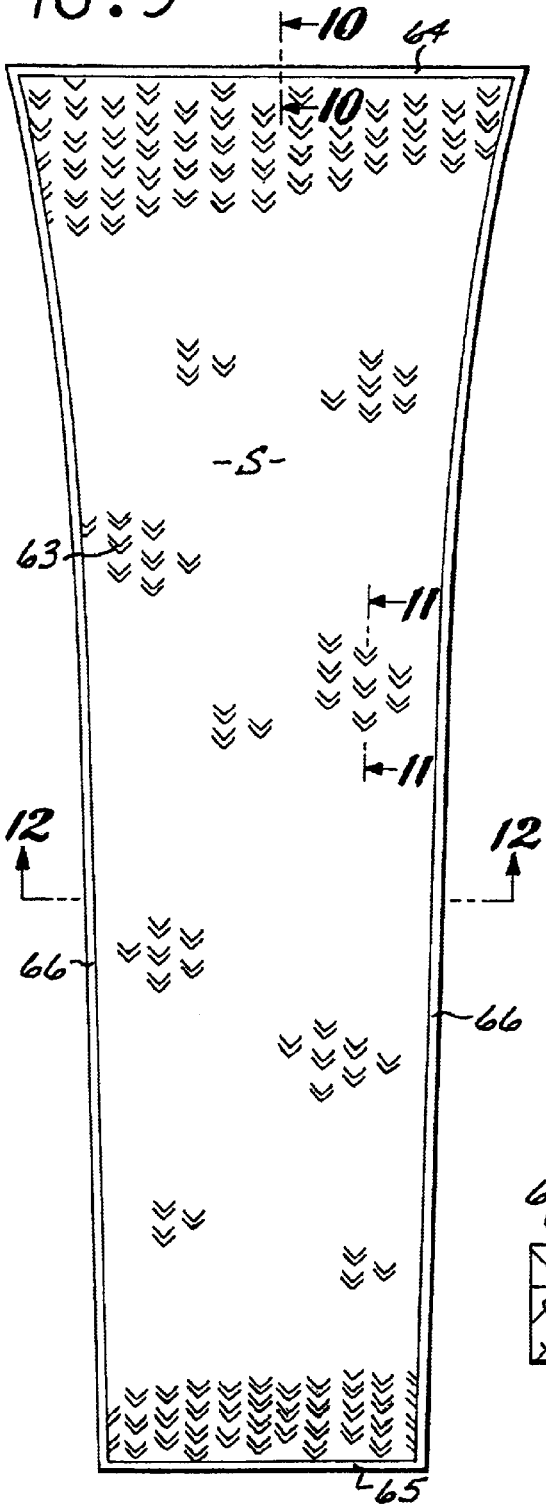
FIG. 9 is a side elevational view of the single panel of FIGS. 1–3 after it is removed from the mold shown in FIGS. 4–8.
Figure 10:
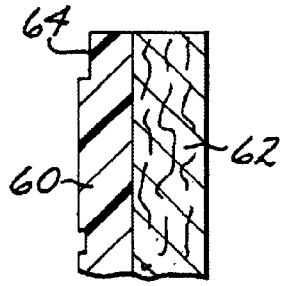
FIG. 10 is an enlarged vertical sectional view taken along line 10—10 of FIG. 9.
Figure 11:
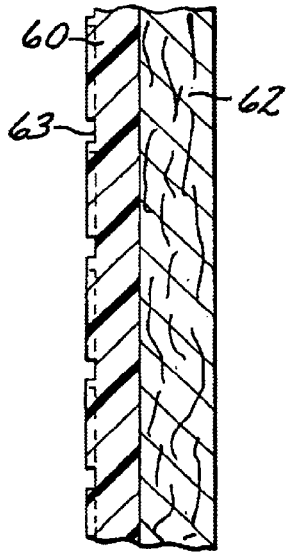
FIG. 11 is an enlarged sectional view taken along line 11—11 of FIG. 9.
Figure 12:
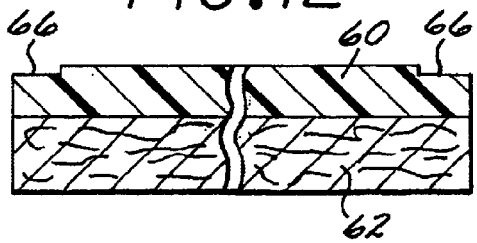
FIG. 12 is a broken horizontal sectional view taken along line 12—12 of FIG. 9.
Figures 13, 14, 15, 16:
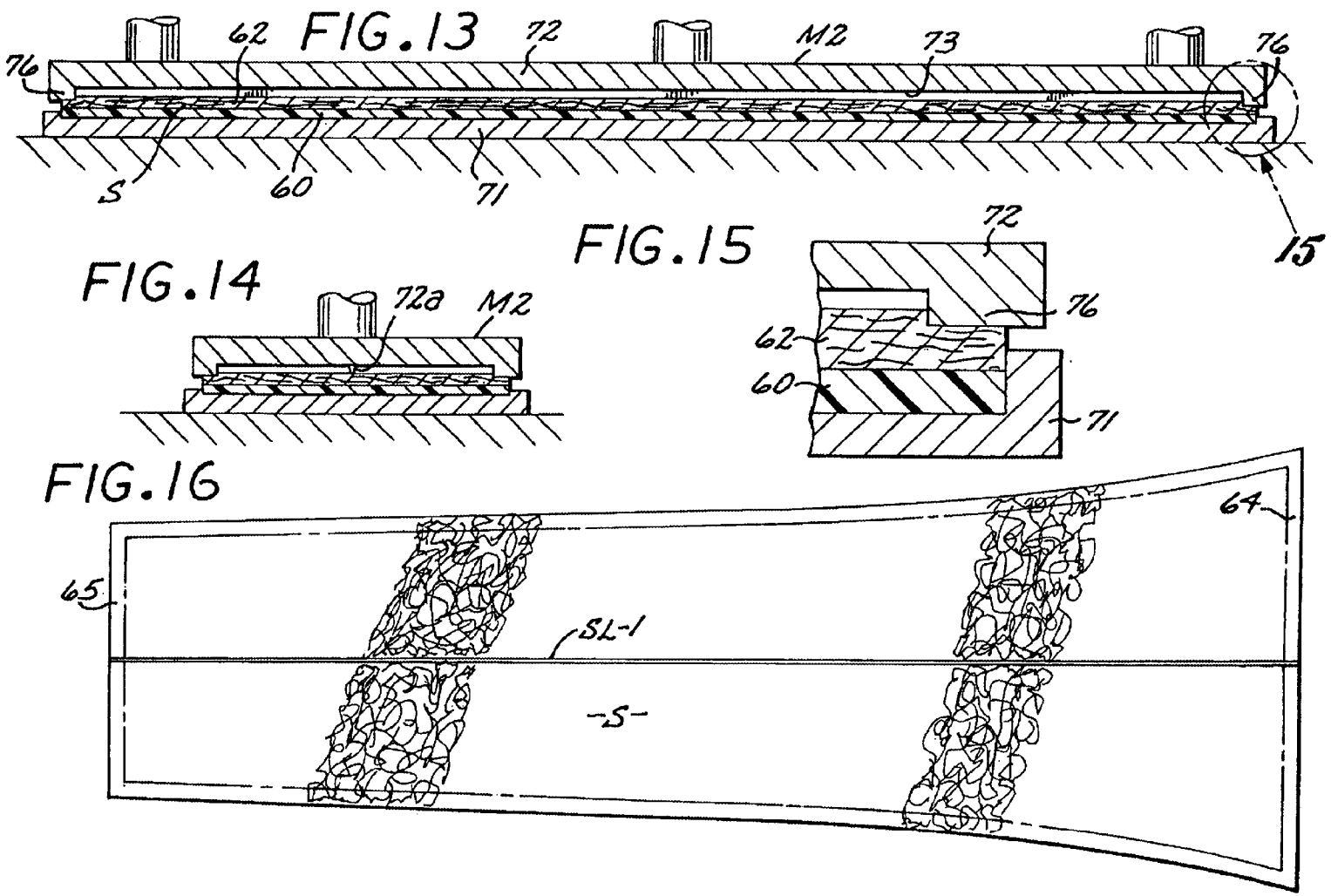
FIG. 13 is a horizontal sectional view of a second mold utilized in forming a single panel grip of the present invention.
FIG. 14 is a vertical sectional view taken along line 14—14 of FIG. 13.
FIG. 15 is an enlarged view of the encircled area designated 15 in FIG. 13.
FIG. 16 is a view showing the appearance of the interior surface of the single panel after such panel has been removed from the mold of FIGS. 13–15.

Referring now to FIGS. 4–12 there is shown a first mold M which is utilized to form a friction enhancing pattern 63 (FIG. 9) on the outer surface of polyurethane layer 60, and upper and lower heat depressed horizontal edges 64 and 65 along the upper and lower ends of the single panel S and depressed horizontal edges 66 along the sides of the panel. Mold M includes a base plate B and a heated platen 67 formed with a cavity 68. The ends of the cavity 68 are provided with depending protrusions 69 that engage the upper surface of the polyurethane layer 60 so as to form the depressed friction enhancing pattern 63, as seen in FIG. 6. In FIG. 5 depending protrusions 69*a* form recessed edges 66. In FIG. 8 it will be seen that the right-hand edge of the cavity 68 is formed with a shoulder 70 which engages the upper end of the panel S to form heat recessed upper edge 64 in polyurethane layer 60. The left-hand side of the cavity is formed with a similar shoulder 71 to form the heat depressed recessed edge 65 along the lower edge of the panel.

Referring now to FIGS. 13–16 there is shown a second mold M2 utilized inmaking a single panel grip of the present invention. Panel S is shown inverted from its position in mold M. Such mold includes a base plate 71 and a heated platen 72 formed with a cavity 73. The base plate is also formed with a cavity 74 that receives exterior of the polyurethane layer 60 while the felt layer is received within the cavity 73 of the heated platen 72. The upper and lower sides and the edges of the heated platen 72 are formed with a depending peripheral shoulder 76 that engage the upper and lower edges of the felt layer 62, as well as the side edges of such felt layer. When the heated platen 72 is urged downwardly towards the felt layer the periphery thereof will be depressed by the shoulders 76 and heat will be transferred through such felt layer to densify the peripheral edges of the polyurethane layer 60. The densification is effected by the heat transferred from the shoulders 76 through the felt layer 62. Heated platen 72 is also provided with a depending spur 72*a* (FIG. 14) which forms a score line SL-1 along the longitudinal center of the felt layer 62 shown in FIG. 16.

Figure 17:
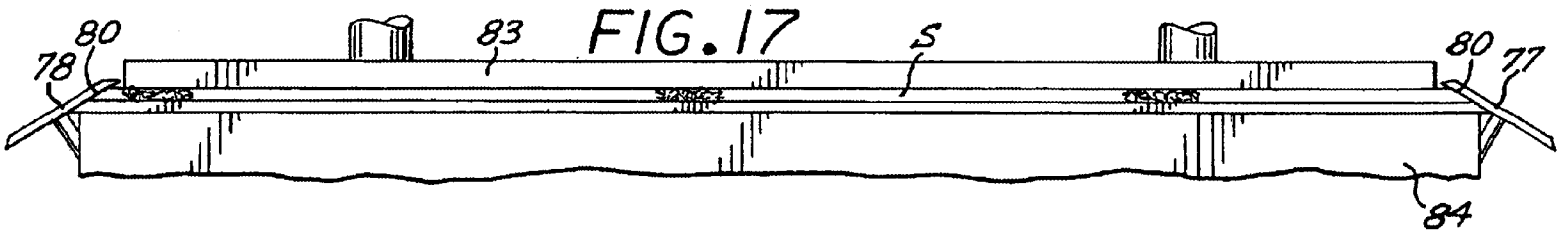
FIGS. 17, 18 and 19 show the side edges of the single panel being skived.
Figure 19:
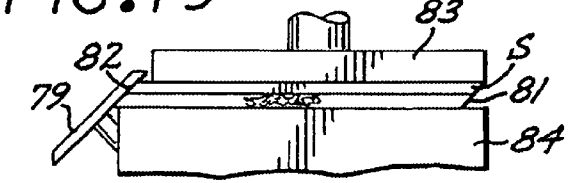
Figure 18:
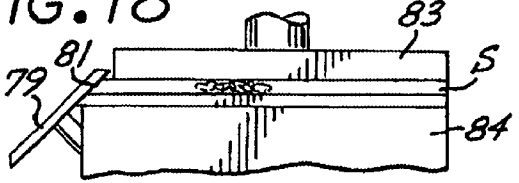
Figure 20:
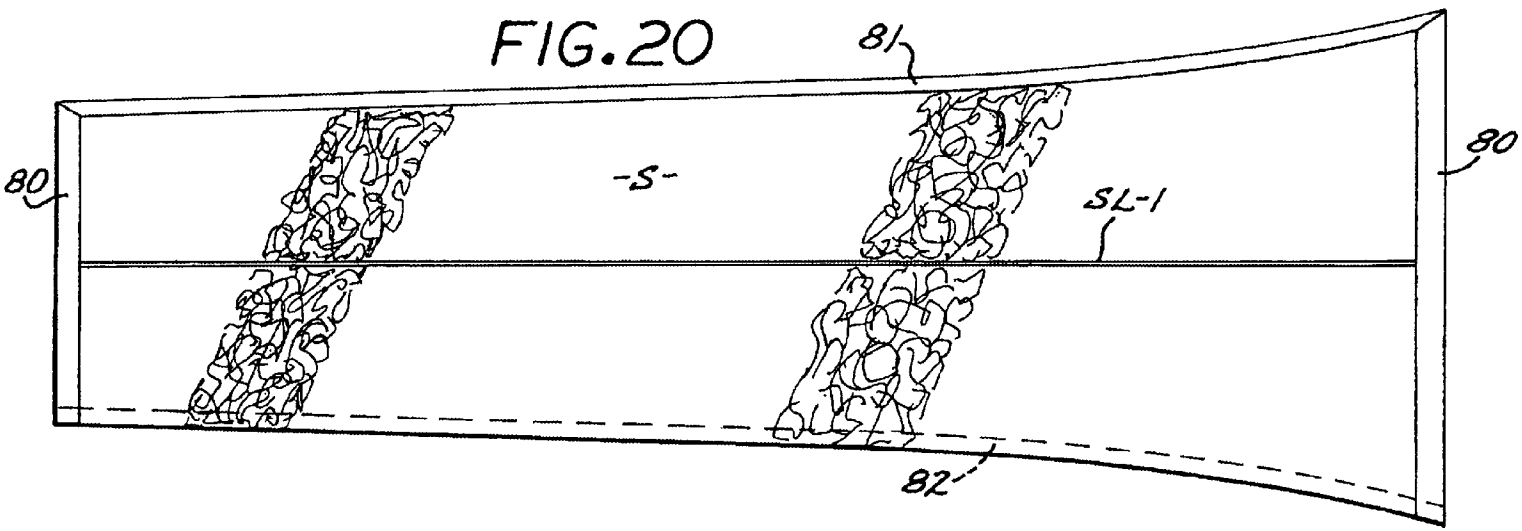
FIG. 20 shows the interior surface of the single panel after the side edges thereof have been skived in the manner depicted in FIGS. 17, 18 and 19.

Referring now to FIGS. 17–20 the peripheral edges of the panel S are shown being skived by a pair of rotating knives, 77 and 78 which engage the upper and lower edges of the panel, as shown in FIG. 17, and a single rotating knife 79. Knives 77 and 78 form upper and lower skived edges 80. Knife 79 is shown forming skived edge 81 on one side of the panel S in FIG. 18 and the other skived edge 82 side in FIG. 19 after the first side has been skived. A pressure plate 83 is utilized to secure the panels on base 84 during the skiving operation. It will be noted that the skiving on the opposite sides of the panel S are parallel to one another, as seen in FIG. 19. Preferably, the skiving will have a width of about 4.0–6.0 millimeters.

Referring now to FIGS. 21–24 there is shown an underlisting sleeve U formed of a resilient material such as a natural or synthetic rubber or plastic. Sleeve U includes an integral cap 85 at its upper end, while the lower end of the sleeve is formed with an integral nipple 86. The underside of the cap is formed with a circumferentially downwardly extending slot 87. The slot 87 receives the upper edge of the panel S as described hereinafter. The nipple 86 is formed with an upwardly extending slot 88 which is defined by a peripheral lip 89 formed outwardly of the slot so as to admit the lower edge of the panel S in a manner to be described hereinafter. Preferably, underlisting sleeve U will be formed with a vertically extending score line SL-2.

Figure 25:
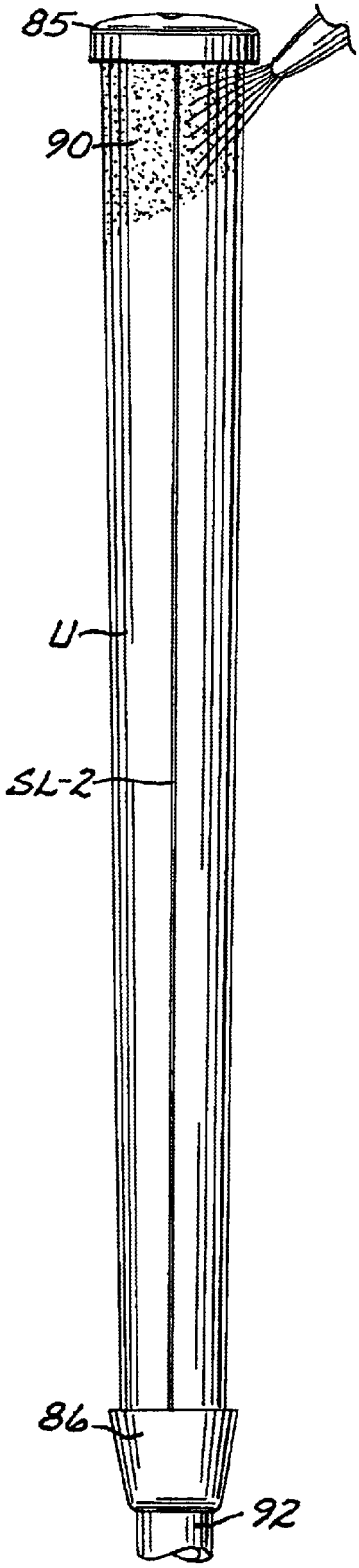
FIG. 25 is a side elevational view showing adhesive being applied to the exterior of the underlisting sleeve.
Figure 26:
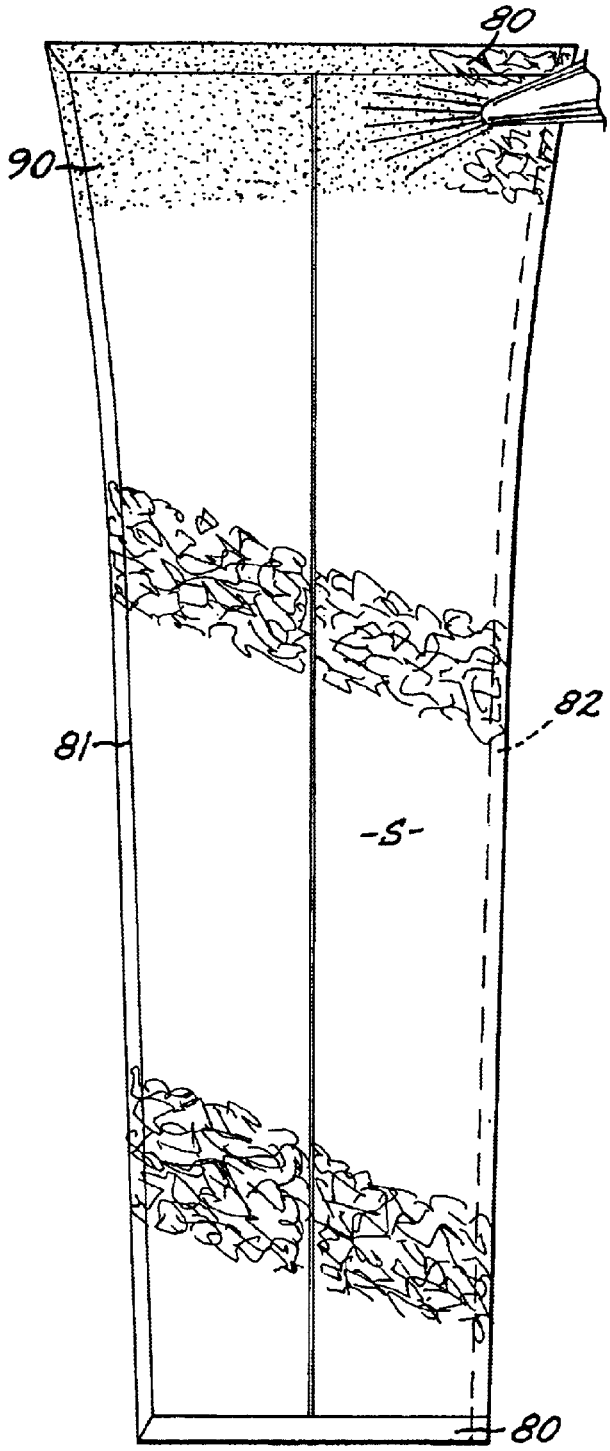
FIG. 26 is a side elevational view showing adhesive being applied to the interior surface of the single panel.

Referring now to FIGS. 25–32 the panel S is shown being applied to underlisting sleeve U. In FIG. 25 the exterior surface of the underlisting sleeve U is shown receiving an adhesive 90 by means of a nozzle, brush or the like. In FIG. 26 the inner surface of the felt layer 62 is shown receiving an adhesive 90 by means of a nozzle, brush or the like.

Figure 27:
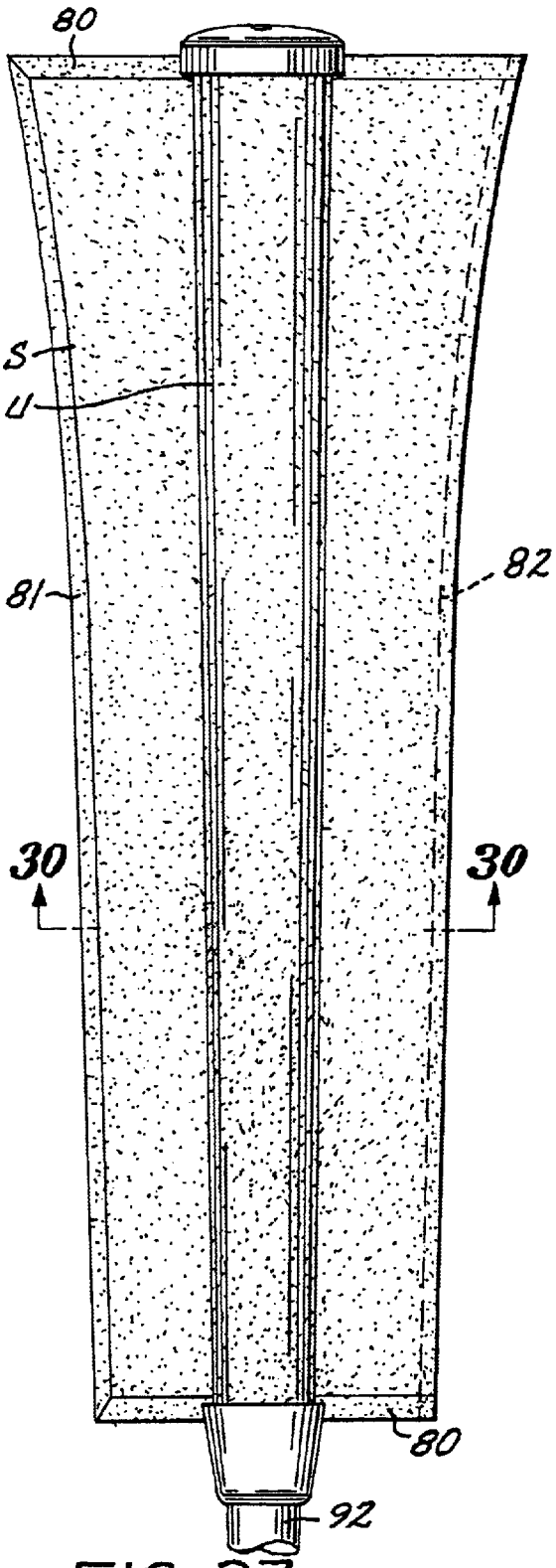
FIG. 27 is a side elevational view showing a first step in wrapping and adhering the single panel to an underlisting sleeve.
Figure 28:
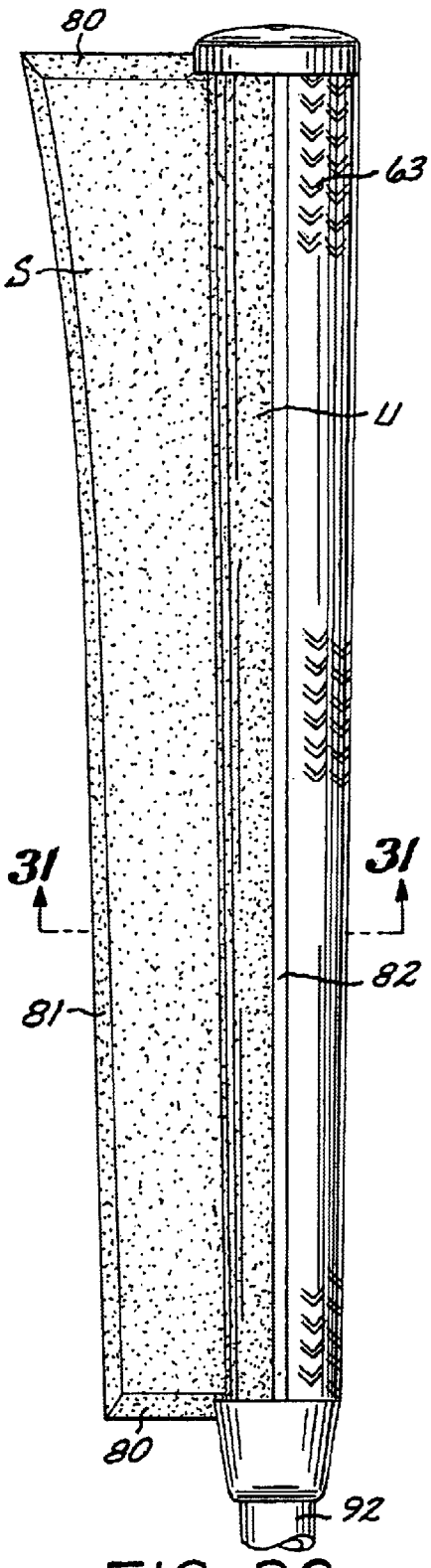
FIG. 28 is a side elevational view showing the second step in wrapping the single panel around an underlisting sleeve.
Figure 29:
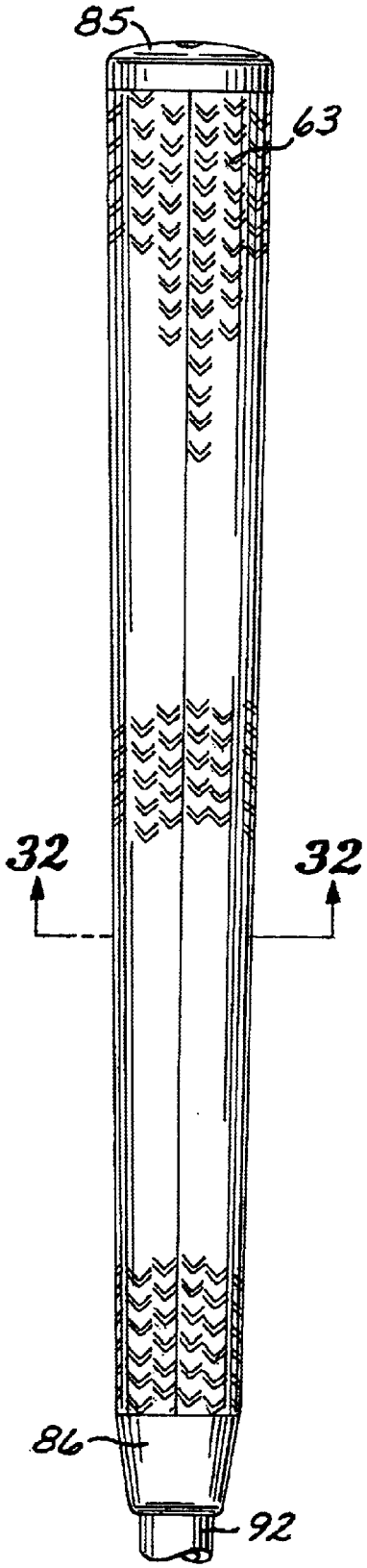
FIG. 29 is a side elevational view showing the single panel after it has been adhered to the underlisting sleeve.
Figure 30:
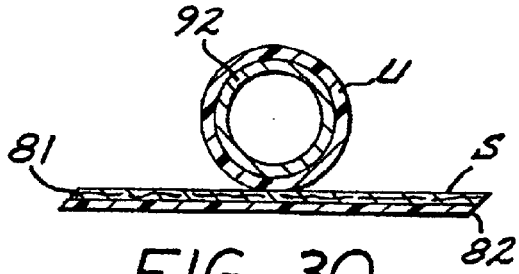
FIG. 30 is a horizontal sectional view taken along line 30—30 of FIG. 27.
Figure 31:
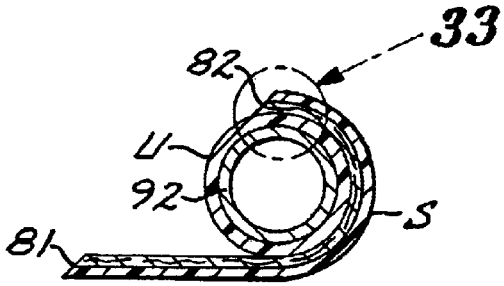
FIG. 31 is a horizontal sectional view taken along line 31—31 of FIG. 28.
Figure 32:
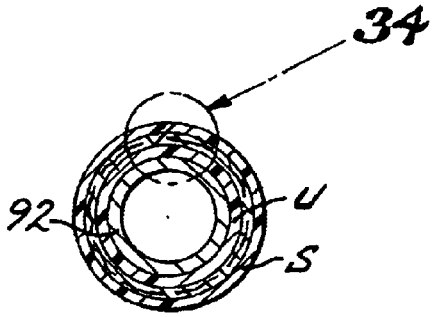
FIG. 32 is a horizontal sectional view taken along line 32—32 of FIG. 29.
Figures 33, 34, 35, 36, 37, 38:
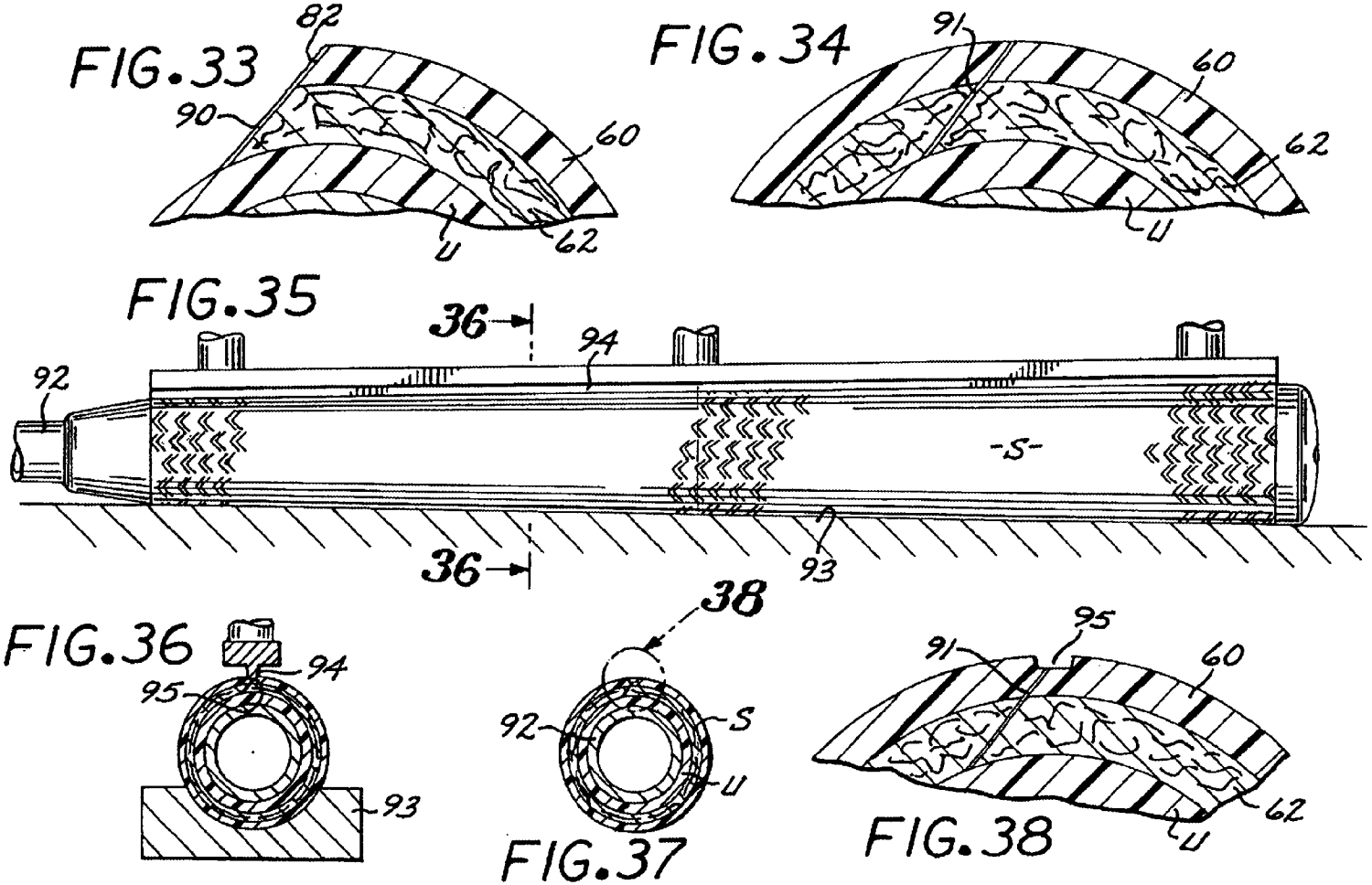
FIG. 33 is an enlarged view of the encircled area designated 33 in FIG. 31.
FIG. 34 is an enlarged view of the encircled area designated 34 in FIG. 32 showing a seam between the side edges of the single panel.
FIG. 35 is a side elevational view showing a heat depressed sealing channel being formed along the top portion of the seam shown in FIG. 34.
FIG. 36 is a vertical sectional view taken along line 36—36 of FIG. 35.
FIG. 37 shows the parts of FIG. 36 after the sealing channel has been formed.
FIG. 38 is an enlarged view of the encircled area designated 38 in FIG. 37.
Figure 46:
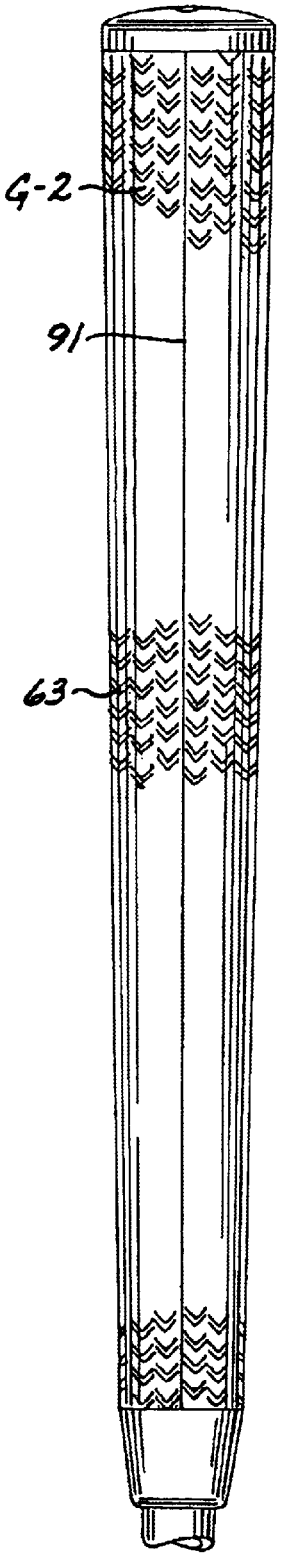
FIG. 46 is a side elevational view of another modification of the grip of FIG. 39.
Figure 47:
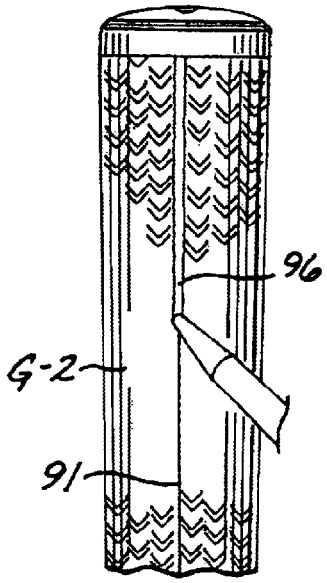
FIG. 47 is a broken side elevational view showing a first step in making the grip of FIG. 46.
Figure 48:
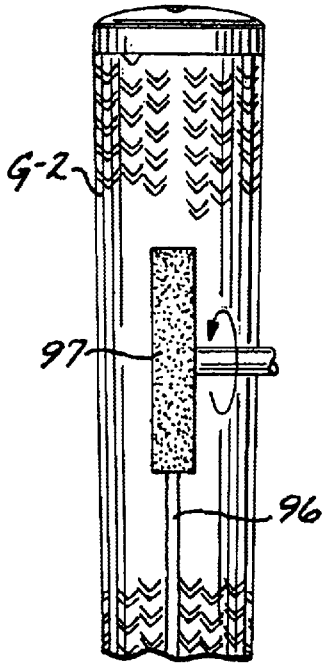
FIG. 48 is a view similar to FIG. 44 showing a second step in making the grip of FIG. 46.

In FIG. 27 shows the panel S shown being wrapped around and adhered to the underlisting sleeve U. During this operation the score lines SL-1 and SL-2 will be disposed in alignment. Also, the upper edge of the panel S will be manually inserted within the circumferential slot 87 of the underlisting cap 85, while the lower edge of such panel is manually inserted within the slot 89 formed within the nipple 86 by temporarily flexing the peripheral lip 89 outwardly. As indicated in FIGS. 32, 33 and 34, the skived side edges 81 and 82 of the panel S will be adhered together by a suitable adhesive 90 so as to define a seam 91 extending through the panel. Because of the skived side edges, the seam 91 extends through the panel at an angle relative to the depth of the panel S so as to increase the length of such seam as compared to a seam extending parallel to the depth of the panel. Increased length of the seam affords a stronger bond. The seam is particularly strong where it joins the felt layers together. A suitable adhesive 90 has the chemical formula polychloroprene ($C_4H_5Cl$) and Toluene ($CH_5CH_3$). As the panel S is being wrapped about and adhered to underlisting sleeve U, the sleeve will be temporarily supported on a collapsible mandrel 92 in a conventional manner. Referring to FIGS. 35–38, after the side edges of the panel S have been adhered together, the underlisting sleeve will be supported by mandrel 92 upon a base 93 while a longitudinally extending heated pressure tooth 94 (FIG. 36) is urged against the polyurethane layer 60 at the outer edge of seam 91. Such heated tooth forms a small depression 95 in the polyurethane layer 60 aligned with the outer edge of the seam 91 so as to further strengthen such seam. The first form of completed grip G is shown in FIGS. 39–41. Referring to FIGS. 40 and 41, it will be seen that the upper edge of the panel S is securely disposed within cap slot 87 and the bottom of the panel is securely disposed within the nipple slot 88. The completed grip is then removed from mandrel 92 and is ready to be slipped onto and adhered to the shaft of a golf club G in a conventional manner.

FIGS. 42–45 show a golf club grip G-1 similar in all respects to grip G with the exception that the depression 95 is filled with hot polyurethane 96 by a nozzle or brush (FIG. 42). After the polyurethane hardens, it can be buffed by a suitable brush 97 or the like to smoothly blend into the surface of the grip as shown in FIG. 43. Alternatively, after channel 96 is filled with hot polyurethane it is not buffed.

Figure 49:
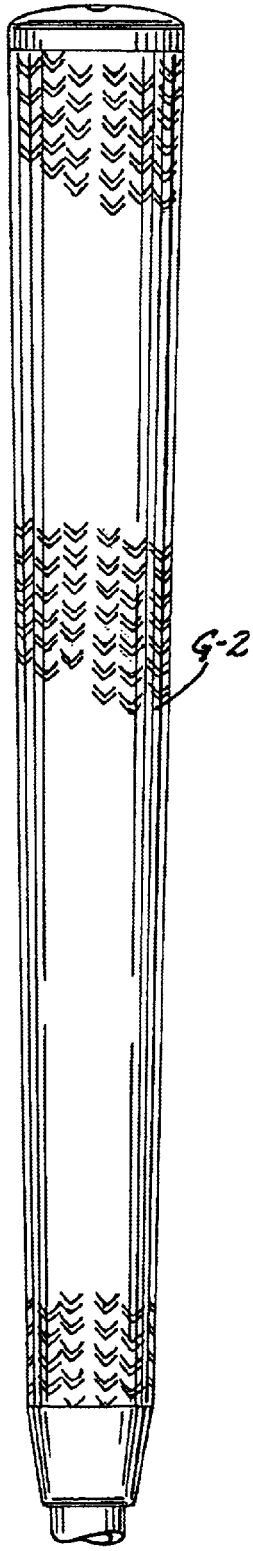
FIG. 49 is a side elevational view of the completed grip of FIG. 46.
Figure 50:
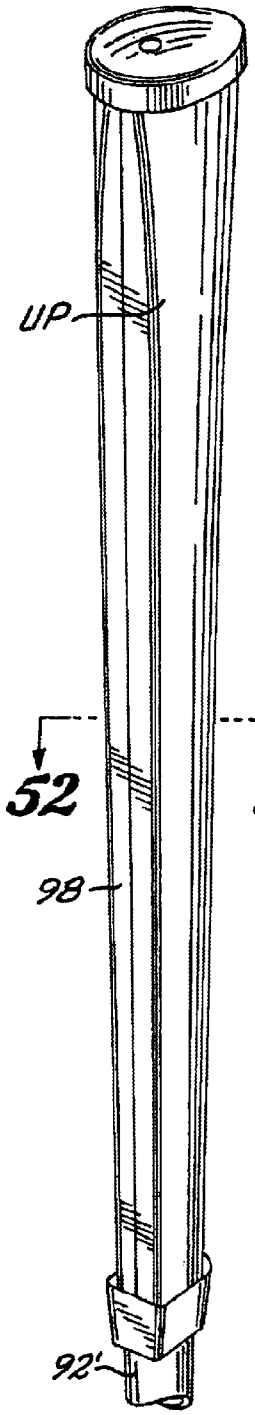
FIG. 50 is a perspective view of an underlisting sleeve of a putter grip embodying the present invention.
Figure 51:
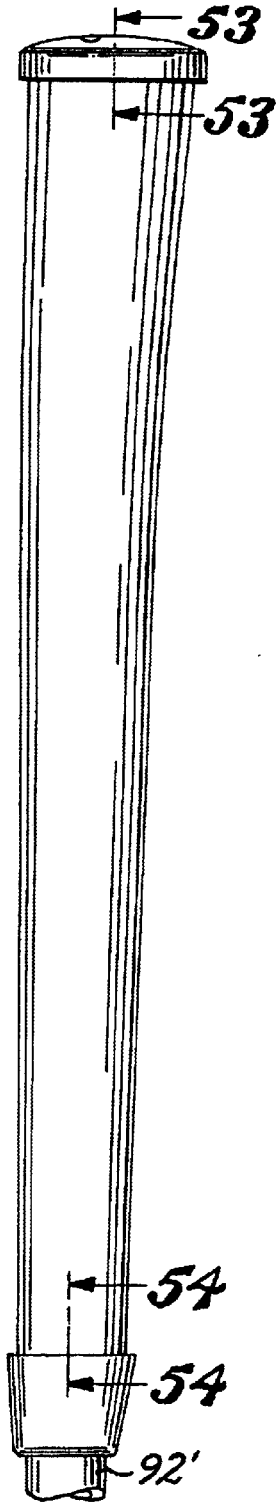
FIG. 51 is a side elevational view of the underlisting sleeve of FIG. 50.
Figure 52:
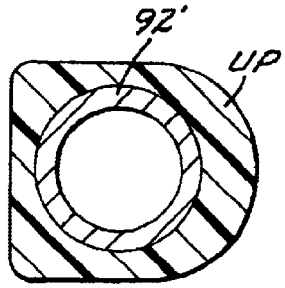
FIG. 52 is a horizontal sectional view taken in enlarged scale along line 52—52 of FIG. 50.
Figure 53:
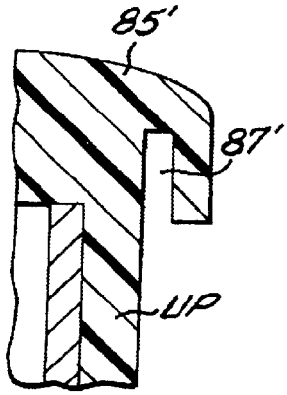
FIG. 53 is a broken vertical sectional view taken in enlarged scale along line 53—53 of FIG. 51.
Figure 54:
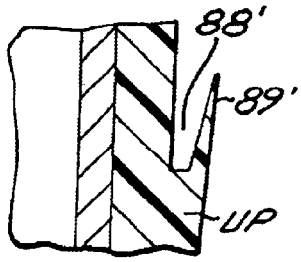
FIG. 54 is a vertical sectional view taken in enlarged scale along line 54—54 of FIG. 51.
Figure 55:
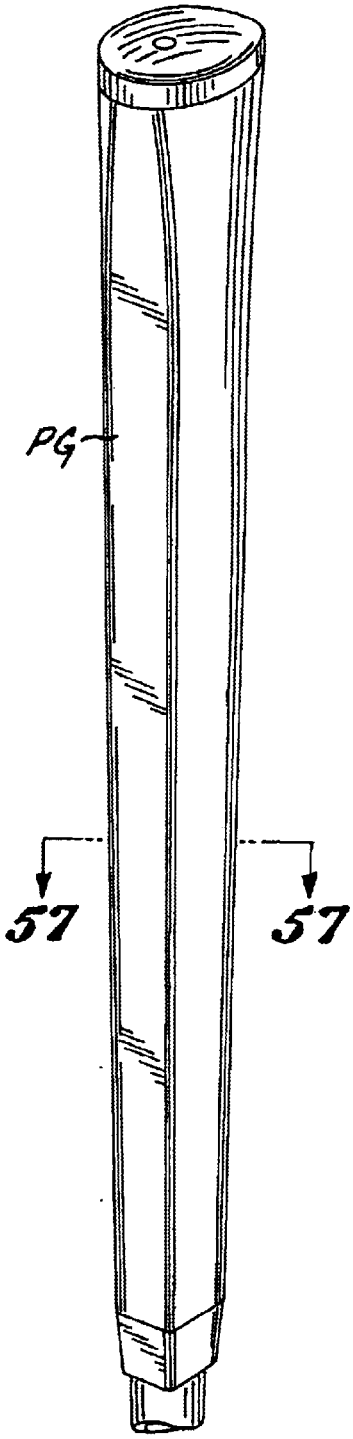
FIG. 55 is a perspective view of a completed single panel putter grip embodying the present invention.
Figure 56:
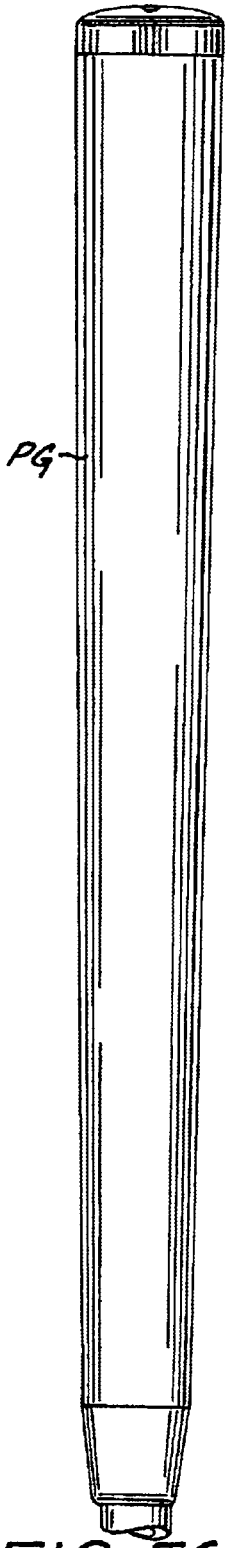
FIG. 56 is a rear elevational rear view of the putter grip of FIG. 55.

Referring now to FIGS. 46–49 there is shown another modification of a grip G-2 embodying the present invention. In this modification the depressed reinforcement channel 95 is not utilized. Instead, after the seam 91 has been formed, a small quantity of hot polyurethane 96 is coated over the seam by a nozzle or brush, as shown in FIG. 45. After the polyurethane hardens, it may be buffed by a suitable brush 97 or the like to smoothly blend into the surface of the grip, as indicated in FIG. 49. Alternatively, the polyurethane is not buffed.

Figure 57:
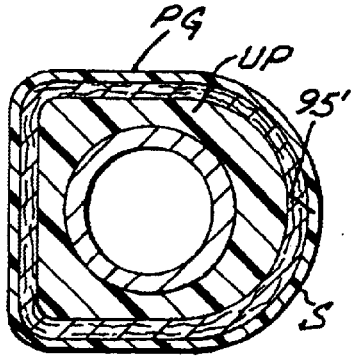
FIG. 57 is a horizontal sectional view taken in enlarged scale along line 57—57 of FIG. 55.
Figure 58:
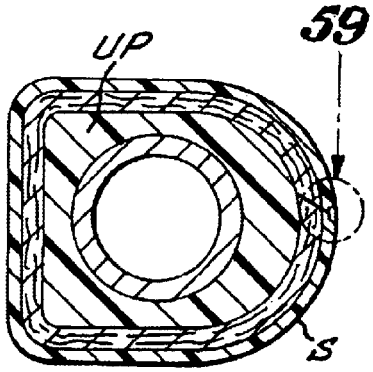
FIG. 58 is a horizontal sectional view similar to FIG. 57 showing a modification of the grip of FIG. 57.
Figure 59:
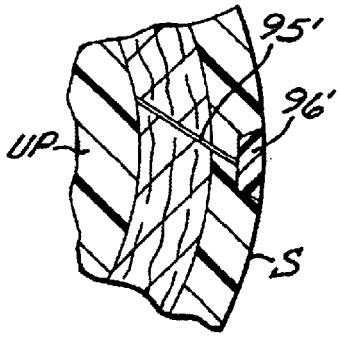
FIG. 59 is an enlarged view of the encircled area designated 59 in FIG. 58.

Referring now to FIGS. 50–59 there is shown a single panel grip PG for use with a conventional putter. The grip includes a resilient underlisting UP (FIGS. 50–54) which is generally similar to the aforedescribed underlisting U, except that underlisting sleeve UP is not of an annular configuration. Instead, the front surface 98 of underlisting sleeve UP is of flat configuration in accordance with the design of most putters in general use. It should be understood that underlisting sleeve UP receives a single panel SP of polyurethane-felt configuration, similar to the aforedescribed single panel S. Such single panel SP is spirally wrapped about and adhered to the underlisting sleeve in the same manner as described hereinbefore with respect to the single panel grip G-2, with like parts of the two grips marked with like reference numerals. Similarly, the channel 95' may be filled with hot polyurethane which is smoothly buffed to provide a smooth surface as shown in FIG. 57. Alternatively, a heat-formed depression 95 may be formed over seam 91', with the seam being covered with hot polyurethane which is buffed off when such polyurethane hardens to provide a smooth surface over the seam as shown in FIGS. 56–59. The outer surface of the polyurethane layer of putter grip PG may be smooth or may be formed with a friction enhancing pattern.

Figure 60:
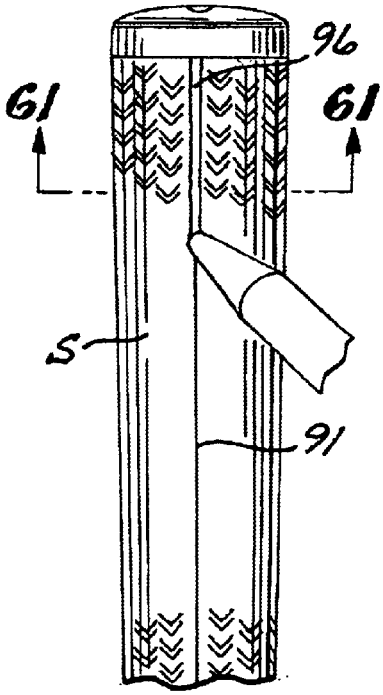
FIG. 60 is a broken side elevational view showing another modification of the grip of FIG. 49.
Figure 63:
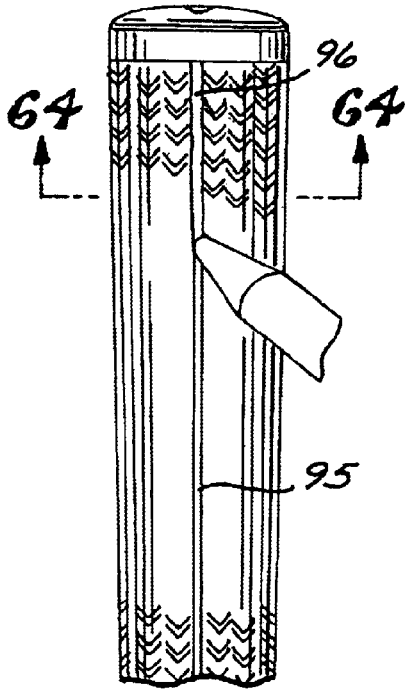
FIG. 63 is a broken side elevational view of a modification of the grip of FIG. 60.
Figure 61:
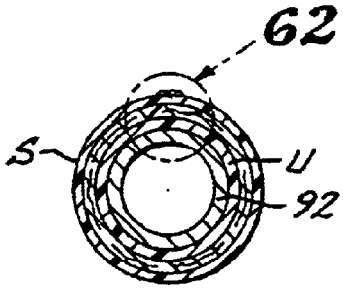
FIG. 61 is a horizontal sectional view taken along line 61—61 of FIG. 60.
Figure 64:
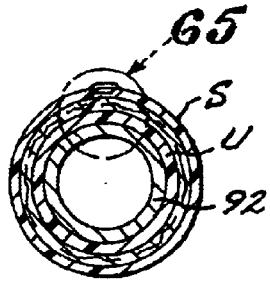
FIG. 64 is a horizontal sectional view taken along line 64—64 of FIG. 63.
Figure 62:
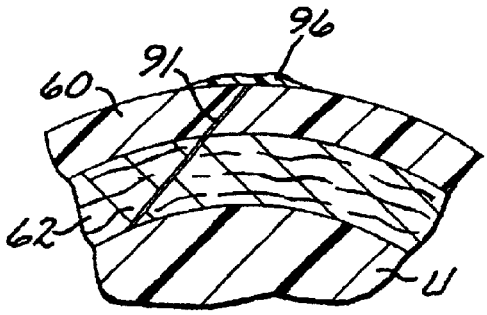
FIG. 62 is an enlarged view of the encircled area designated 62 in FIG. 61.
Figure 65:
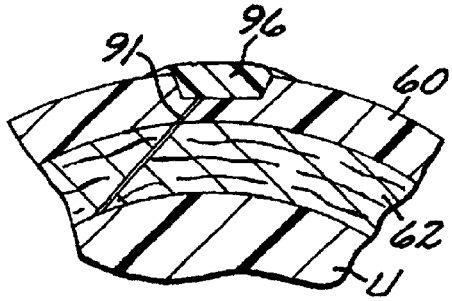
FIG. 65 is an enlarged view of the encircled area designated 65 in FIG. 64.
Figures 66, 67, 68, 69, 70:
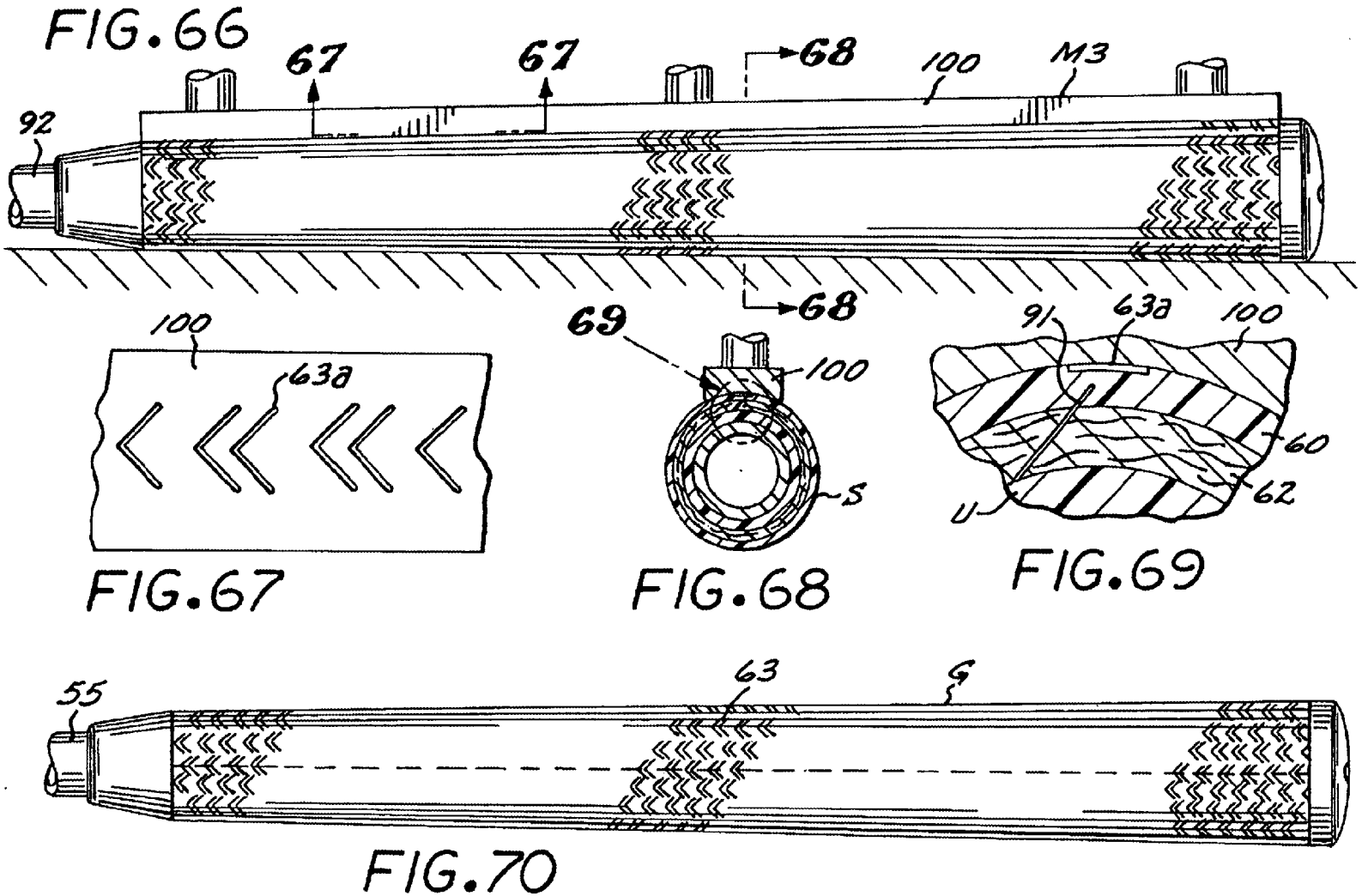
FIG. 66 is a side elevational view of a die utilized in making the grips of FIGS. 60 and 63.
FIG. 67 is a horizontal sectional view taken along line 67—67 in FIG. 66.
FIG. 68 is a vertical sectional view taken along line 68—68 of FIG. 66.
FIG. 69 is an enlarged view taken along line 69—69 of FIG. 66.
FIG. 70 is a side elevational view of a grip made in accordance with FIGS. 60–69.

Referring to FIGS. 60–70 there is shown a modification of the grips of FIGS. 27–49. In FIGS. 60–62 hot polyurethane 96 is shown being coated over the seam 91 by a nozzle or brush. In FIGS. 63–65 hot polyurethane 96 is shown filling the depression 95 by a nozzle or brush. FIG. 66 shows a mold M 3 having a heated platen 100 the underside of which is formed with a segment 63*a* of the friction enhancing pattern 63 which is embossed on the surface of the polyurethane layer 60 of the grip. Such heated platen 63*a* is depressed against the outer surface of the polyurethane layer over the area of the seam 91 while the polyurethane is still hot. With this arrangement the area of the exterior of the polyurethane layer outwardly of the seam is formed with the friction enhancing segment of FIG. 67 whereby such segment merges with the friction enhancing pattern 63 molded on the main body of the outer surface of the grip, as indicated in FIG. 70.

Referring now to FIG. 71 there is shown a golf club GC having a handle 55 upon which has been telescopically secured a grip G made in accordance with the aforedescribed description. FIG. 72 shows a putter grip PG which is telescopically applied to the handle 57 of a putter P.

It should be understood that the outer surface of a grip embodying the present invention may be coated by means of a brush or spray with a thin layer of polyurethane (not shown) to protect such surface, add tackiness thereto, and increase the durability thereof.

A golf club grip of the present invention provides the several advantages over existing wrapped grips described hereinbefore. Additionally, such grip has the appearance of a molded, one-piece grip familiar to professional and low-handicap golfers. Although some of such golfers are reluctant to use a non-traditional wrapped club, they are willing to play with a structurally integral grip of the present invention, since such grip affords the shock-absorbing and tackiness qualities of a wrapped grip.

Various modifications and changes may be made with respect to the foregoing detailed description without departing from the spirit of the present invention.

What is claimed is:

1. A grip for the handle of a golf club, such grip comprising:

a resilient underlisting sleeve that is telescopically slipped onto the handle of a golf club;

a single panel that includes a polyurethane outside layer bonded to a felt inside layer, such panel having a configuration corresponding to the exterior shape of the resilient sleeve;

the single panel being wrapped about and adhered to the underlisting sleeve; and with the side edges of the panel abutting one another and being adhered together to define a longitudinal seam extending from the interior surface of the panel to the exterior surface of the polyurethane layer.

2. A golf club grip an set forth in claim 1 wherein the side edges of the panel are skived so that the seam extends through the panel at a slanted angle relative to the depth of the panel.

3. A golf club grip as set forth in claim 2 wherein a heat depressed channel is formed in the polyurethane layer exteriorally along the length of the seam to reinforce the seam.

4. A golf club grip as set forth in claim 3 wherein the seam is covered by a deposit of polyurethane.

5. A golf club grip as set forth in claim 4 wherein the deposit of polyurethane is smoothly buffed.

6. A golf club grip as set forth in claim 1 wherein a heat depressed channel is formed in the polyurethane layer exteriorally of the seam to reinforce the seam.

7. A golf club grip as set forth in claim 6 wherein the heat depressed channel is covered by smooth buffed polyurethane.

8. A golf club grip as set forth in claim 1 wherein the seam is covered by a deposit of polyurethane.

9. A golf club grip as set forth in claim 8 wherein the deposit of polyurethane is smoothly buffed.

10. A grip for the handle of a golf club, such grip comprising:

a resilient underlisting sleeve that includes a cap formed with a downwardly facing slot and a nipple formed with an upwardly facing circumferential slot, the outer portion of the nipple groove being defined by a peripheral lip;

a single panel that includes a polyurethane layer bonded to a felt inside layer, such panel having a configuration corresponding to the exterior shape of the resilient sleeve;

the single panel being wrapped about and adhered to the underlisting sleeve, with the side edges of the panel abutting and adhered to one another to define a longitudinal seam extending from the interior surface of the panel to the exterior surface of the polyurethane layer;

with the upper edge of the panel being firmly retained in the cap slot and the lower edge of the panel being firmly retained in the nipple slot by the peripheral lip; and wherein the outside of the seam is covered with a deposit of polyurethane.

11. A golf club grip as set forth in claim 10 wherein the side edges of the panel are skived so that the seam extends through the panel at a slanted angle relative to the depth of the panel.

12. A golf club grip as set forth in claim 10 wherein the polyurethane deposit is smoothly buffed.

13. A grip for the handle of a golf club, such grip comprising:

a resilient underlisting sleeve that includes a cap formed with a downwardly facing slot and a nipple formed with an upwardly facing circumferential slot, the outer portion of the nipple groove being defined by a peripheral lip;

a single panel that includes a polyurethane layer bonded to a felt inside layer, such panel having a configuration corresponding to the exterior shape of the resilient sleeve;

the single panel being wrapped about and adhered to the underlisting sleeve, with the side edges of the panel abutting and adhered to one another to define a longitudinal seam extending from the interior surface of the panel to the exterior surface of the polyurethane layer;

with the upper edge of the panel being firmly retained in the cap slot and the lower edge of the panel being firmly retained in the nipple slot by the peripheral lip; and wherein a heat depressed channel is formed along the length of the polyurethane layer over the seam to further strengthen the seam and wherein the heat depressed channel is covered by a deposit of polyurethane.

14. A golf club grip as set forth in claim 13 wherein the polyurethane deposit is smoothed.

15. A golf club grip as set forth in claim 13 wherein the side edges of the panel are skived so that the seam extends through the panel at a slanted angle relative to the depth of the panel.

16. A grip for the handle of a golf club, such grip comprising:

a resilient underlisting sleeve that is telescopically slipped onto the handle of a golf club;

a single panel that includes a polyurethane outside layer bonded to a felt inside layer, such panel having a configuration corresponding to the exterior shape of the resilient sleeve;

a friction enhancing pattern formed on the outside of the polyurethane layer;

the single panel being wrapped about and adhered to the underlisting;

with the side edges of the panel abutting one another and being adhered together to define a longitudinal seam extending from the interior surface of the panel to the exterior surface of the polyurethane layer;

a heat depressed channel formed in the polyurethane layer exteriorally of the seam to reinforce the seam;

a polyurethane deposit over the seam; and a segment of the friction enhancing pattern formed outwardly of the seam so as to merge with the friction enhancing pattern formed on the outside of the polyurethane layer.

17. A golf club grip as set forth in claim 16 wherein the seam extends through the panel at a slant.

18. A grip as set forth in claim 16 wherein the resilient underlisting sleeve includes a cap formed with a downwardly facing slot and a nipple formed with an upwardly facing circumferential slot, the outer portion of the nipple groove being defined by a peripheral lip, with the upper edge of the panel being firmly retained in the cap slot and the lower edge of the panel being firmly retained in the nipple slot by the peripheral lip.

19. A grip for the handle of a golf club, such grip comprising:

a resilient underlisting sleeve that is telescopically slipped onto the handle of a golf club;

a single panel that includes a polyurethane outside layer bonded to a felt inside layer, such panel having a configuration corresponding to the exterior shape of the resilient sleeve;

a friction enhancing pattern formed on the outside of the polyurethane layer;

the single panel being wrapped about and adhered to the underlisting with the side edges of the panel abutting one another and being adhered together to define a longitudinal seam extending from the interior surface of the panel to the exterior or surface of the polyurethane layer, a heat depressed channel formed in the polyurethane layer exteriorially of the seam to reinforce the seam; a polyurethane deposit in the channel; and a segment of the friction enhancing pattern formed in the polyurethane deposit outwardly of the seam so as to merge with the fiction enhancing pattern formed on the outside of the polyurethane layer.

20. A grip as set forth in claim 19 wherein the resilient underlisting sleeve includes a cap formed with a downwardly facing slot and a nipple formed with an upwardly facing circumferential slot, the outer portion of the nipple groove being defined by a peripheral lip; and the upper edge of the panel being firmly retained in the cap slot and the lower edge of the panel being firmly retained in the nipple slot by the peripheral lip.

21. A method of making a grip for the handle of a golf club, such method including the steps of:

providing a resilient underlisting sleeve that is telescopically slipped onto the handle of a golf club;

providing a single panel that includes a polyurethane outside layer bonded to a felt inside layer, such panel having a configuration corresponding to the exterior shape of the resilient sleeve;

wrapping the single panel about and adhering it to the underlisting sleeve; and abutting the side edges of the panel together and adhering such side edges together to define a longitudinal seam extending from the interior surface of the panel to the exterior surface of the polyurethane layer; and which includes the further step of covering the seam with polyurethane.

22. A method as set forth in claim 21 which includes the additional step of skiving the side edges of the panel so that the seam extends through the panel at a slanted angle relative to the depth of the panel.

23. A method of making a grip for the handle of a golf club, such method including the steps of:

providing a resilient underlisting sleeve that is telescopically slipped onto the handle of a golf club;

providing a single panel that includes a polyurethane outside layer bonded to a felt inside layer, such panel having a configuration corresponding to the exterior shape of the resilient sleeve;

wrapping the single panel about and adhering it to the underlisting sleeve; and abutting the side edges of the panel together and adhering such side edges together to define a longitudinal seam extending from the interior surface of the panel to the exterior surface of the polyurethane layer;

which includes the further step of forming a heat depressed channel in the polyurethane layer exteriorally of the seam to reinforce the seam; and which includes the further step of depositing polyurethane in the channel.

24. A method of making a grip for the handle of a golf club, such method including the steps of providing a resilient underlisting sleeve;

providing a single panel that includes a polyurethane layer bonded to a felt inside layer, such panel having a configuration corresponding to the exterior shape of the resilient sleeve;

forming a friction enhancing pattern on the exterior of the polyurethane layer;

wrapping the single panel about and adhering it to the underlisting sleeve;

applying a deposit of polyurethane over the length of the seam; and forming a segment of the friction enhancing pattern over the polyurethane deposit outwardly of the seam whereby the segment merges with the friction enhancing pattern formed on the outside of the polyurethane layer.

25. A method as set forth in claim 24 which includes the further step of forming a heat depressed channel in the polyurethane layer exteriorally of the seams with such channel receiving the polyurethane deposit.

26. A method as set forth in claim 25 wherein the underlisting sleeve include, a cap formed with a downwardly facing slot, and the sleeve also including a nipple formed with an upwardly facing circumferential slot defined by a peripheral lip; and urging the upper edge of the panel into the circumferential slot of the cap and the bottom edge of the panel into the circumferential slot of the nipple as the panel is wrapped about the sleeve.

27. The method as set forth in claim 26 which includes the additional stop of skiving the side edges of the panel so that the seam extends through the panel at a slanted angle relative to the depth of the panel.

28. A method as set forth in claim 24 wherein the underlisting sleeve includes a cap formed with a downwardly facing slot, and the sleeve also includes a nipple formed with an upwardly facing circumferential slot defined by a peripheral lip; and urging the upper edge of the panel into the circumferential slot of the cap and the bottom edge of the panel into the circumferential slot of the nipple as the panel is wrapped about the sleeve.

* * * * *